US005294062A

United States Patent [19]

Hendrickson et al.

[11] Patent Number: 5,294,062

[45] Date of Patent: Mar. 15, 1994

[54] APPARATUS FOR RECYCLING ASPHALT MATERIALS

[75] Inventors: Arthur N. Hendrickson, Coram, N.Y.; Lawrence C. Hanlon, South Portland, Me.; Russell W. Anderson, Mahwah, N.J.

[73] Assignee: Rap Process Machinery Corp., Ramsey, N.J.

[21] Appl. No.: 19,117

[22] Filed: Feb. 17, 1993

Related U.S. Application Data

[63] Continuation-in-part of Ser. No. 772,488, Oct. 7, 1991, Pat. No. 5,188,299.

[51] Int. Cl.[5] ..... B02C 13/02

[52] U.S. Cl. ..... 241/67; 241/74; 241/167; 241/299

[58] Field of Search ..... 241/57, 65, 67, 74, 241/167, 23, 299

[56] References Cited

U.S. PATENT DOCUMENTS

| | | |
|---|---|---|
| Re. 31,904 | 6/1985 | Mendenhall . |
| 527,636 | 10/1894 | Walker . |
| 770,823 | 9/1904 | Salzmann . |
| 1,594,046 | 7/1926 | Carr . |
| 2,084,713 | 6/1937 | Thayer . |
| 3,868,817 | 3/1975 | Marion et al. . |
| 3,871,291 | 3/1975 | Lassiter . |
| 3,975,002 | 8/1976 | Mendenhall . |
| 4,028,527 | 6/1977 | Thagard, Jr. . |
| 4,075,710 | 2/1978 | Jakob et al. . |
| 4,106,110 | 8/1978 | Mendenhall . |
| 4,147,436 | 4/1979 | Garbelman et al. . |
| 4,207,062 | 6/1980 | Moench et al. . |
| 4,264,826 | 4/1981 | Ullmann . |
| 4,332,478 | 6/1982 | Binz . |
| 4,347,016 | 8/1982 | Sindelar et al. . |
| 4,354,826 | 10/1982 | Kruger et al. . |
| 4,369,926 | 1/1983 | Rasmussen et al. . |
| 4,373,675 | 2/1983 | Kaufman . |
| 4,422,846 | 12/1983 | Weber et al. . |
| 4,427,376 | 1/1984 | Etnyre et al. . |
| 4,429,645 | 2/1984 | Burton . |
| 4,477,984 | 10/1984 | Wenger . |
| 4,504,149 | 3/1985 | Mendehall . |
| 4,555,182 | 11/1985 | Mendenhall . |
| 4,583,468 | 4/1986 | Reed et al. . |
| 4,612,711 | 9/1986 | Murray . |
| 4,676,740 | 6/1987 | de Beus . |
| 4,692,028 | 9/1987 | Schave . |
| 4,705,404 | 11/1987 | Bruggemann . |
| 4,787,938 | 11/1988 | Hawkins . |
| 4,813,784 | 3/1989 | Musil . |
| 4,844,020 | 7/1989 | Bruhn . |
| 4,892,411 | 1/1990 | Elliott et al. . |
| 4,932,863 | 6/1990 | Anderson . |
| 4,988,289 | 1/1991 | Coucher . |
| 4,989,986 | 2/1991 | Swisher, Jr. . |
| 5,188,299 | 2/1993 | Hendrickson et al. ..... 241/23 |

FOREIGN PATENT DOCUMENTS

| | | |
|---|---|---|
| 0698649 | 11/1979 | U.S.S.R. . |

*Primary Examiner*—Mark Rosenbaum
*Assistant Examiner*—John M. Husar
*Attorney, Agent, or Firm*—Samuelson & Jacob

[57] ABSTRACT

Apparatus for processing asphalt material to be recycled by introducing used asphalt material from the field in relatively large pieces, as received from the field, into one end of a cage-like array of tubular breaker members while simultaneously heating the tubular breaker members from the other end of the cage-like array and rotating the cage-like array about a tilted central axis of rotation to tumble the material within the cage-like array and reduce the size of the pieces of material to a desired aggregate size within a mass of material moving toward the other end of the cage-like array, the tubular breaker members being spaced apart circumferentially such that only the desired aggregate-sized pieces in the mass of material pass radially out of the cage-like array for delivery and reuse, collecting and oxidizing pollutants emanating from the asphalt material being processed and, in an alternate embodiment, generating electrical power for use at the site of the apparatus.

16 Claims, 4 Drawing Sheets

APPARATUS FOR RECYCLING ASPHALT MATERIALS

This is a continuation in part of application Ser. No. 07/772,488, filed Oct. 7, 1991, now U.S. Pat. No. 5,188,299.

The present invention relates generally to the processing of asphalt materials and pertains, more specifically, to recycling existing asphalt pavement materials.

Asphalt has long been the material of choice for pavement and has found widespread use throughout the world in filling the need for more and more pavement. More recently, recycled asphalt products are being specified for use in an effort to conserve materials used in asphalt production. The use of recycled asphalt materials has become more important as existing pavement is reconditioned or replaced and the disposal of the old, replaced pavement material becomes more difficult and more costly. As a result, large amounts of old asphalt material have become available for reuse; however, current practices have limited such reuse to crushing the relatively large pieces of old asphalt materials, as received from the field, and then mixing the crushed, reduced-size recyclable asphalt material with new material. The mixing of recyclable asphalt material with virgin asphalt has led to unstable reactions, produces unwanted amounts of pollutants, and thus severely limits the use of recyclable asphalt materials.

Five basic methods currently are in use for the utilization of recyclable asphalt. In the weigh-hopper method, uncoated virgin aggregate is superheated and then added to recyclable asphalt material in a hopper where heat is transferred quite rapidly from the heated aggregate to the recyclable asphalt material. The result is a tendency toward an unstable reaction at the point of blending, limiting the amount of recyclable asphalt material which can be introduced. In the batch plant bucket elevator method, recyclable asphalt material is metered into a bucket elevator where heat transfer takes place. Again, the percentage of recyclable asphalt material must be limited in order to preclude the emission of excessive pollutants. Another method uses a parallel-flow drum mixer in which virgin aggregates are introduced at the burner end of a drum and are superheated. Recyclable asphalt material is introduced downstream, adjacent the center of the drum, where the recyclable asphalt material is mixed with the superheated virgin aggregate and hot gases. The exposure of fine recyclable asphalt material to the superheated aggregate and hot gases causes a rapid flash-off and the emission of "blue-smoke", a highly undesirable pollutant, in addition to other hydrocarbon emissions. These emissions must be controlled, resulting in strict limitations on the amounts of recyclable asphalt products introduced by the method. In a similar procedure, a separate mixing chamber is used in connection with a parallel-flow drum mixer so that the recyclable asphalt materials are mixed with heated aggregate outside the hot gas stream in the drum. The method enables the introduction of greater amounts of recyclable asphalt materials without the creation of blue-smoke, but hydrocarbon emissions must still be contended with. The use of a counter-flow drum mixer with a separate mixing chamber, wherein the location of the burner is reversed so that virgin material moves toward the burner while exhaust gases move in the opposite direction, constitutes another improvement in that even more recyclable asphalt material can be mixed with virgin material; however, the amount of recyclable asphalt material must still be limited in order to control the emission of pollutants. All of the above-outlined methods usually require a separate scrubber and screening apparatus for sizing the recyclable asphalt material prior to introducing the material into the mix with virgin aggregate.

The present invention provides apparatus which avoids many of the problems encountered in the above-outlined apparatus and methods and exhibits several objects and advantages, some of which may be summarized a follows: Eliminates the need for preliminary crushing and screening of recyclable asphalt materials received from the field, and the equipment needed for such preliminary crushing and screening; precludes direct contact between the recyclable asphalt materials and any open flame or hot gases, thereby eliminating a potential source of pollutants, and especially "blue-smoke" and hydrocarbon emissions; effectively recycles used asphalt materials for use either in a mix containing a very high percentage of recycled product with virgin aggregate and asphalt, or one-hundred percent recycled materials; provides apparatus which is relatively compact and even more portable than before for ready transportation and use directly at a wider variety of project sites; enables increased versatility in complementing existing asphalt plants for the use of recycled asphalt product; provides an environmentally sound approach to the conservation of asphalt products at minimal cost; eliminates the need for disposal of used asphalt materials; effectively deals with pollutants which emanate from the asphalt materials being processed for reuse; enables the practical processing of recyclable asphalt materials for widespread use with efficiency and reliability.

The above objects and advantages, as well as further objects and advantages, are attained by the present invention which may be described briefly as apparatus for processing recyclable asphalt material received from the field in relatively large pieces for delivery in a mass containing desired smaller aggregate-sized pieces for reuse, the apparatus comprising: an elongate drum having a generally cylindrical wall, a central axis, and an interior with an inlet end and an outlet end; mounting means for mounting the drum for rotation about the central axis; a heating chamber adjacent one end of the interior of the drum and extending along the drum toward the other end of the interior of the drum over a first axial portion of the drum, the heating chamber having an interior; a plurality of breaker members connected to the heating chamber for the conduction of heat from the heating chamber to the breaker members, the breaker members being tubular and extending from the heating chamber along a second axial portion of the drum toward the other end of the interior of the drum, each breaker member having an interior extending along the axial length of the breaker member and each interior being in communication with the interior of the heating chamber; heating means for supplying heat to the interior of the heating chamber, such that heat is conducted to the breaker members connected to the heating chamber; feed means for feeding the large pieces of recyclable asphalt material received from the field into the drum, adjacent the inlet end of the interior of the drum; rotational means for rotating the drum about the central axis so as to tumble the large pieces of recyclable asphalt along the drum and the breaker members, thereby simultaneously reducing the size of the relatively large pieces to the desired aggregate-sized pieces and heating the mass containing the desired aggregate-sized pieces, which mass proceeds toward the outlet end for delivery at the outlet end of the interior of the drum; volatile organic compound oxidation means interposed between the heating means and the heating chamber, the volatile organic compound oxidation means having an inlet and an outlet, the inlet communicating with the heating means and the outlet communicating with the heating chamber; and gas conduction means interconnecting the interior of the drum with the inlet of the volatile organic compound oxidation means for conducting pollutants from the interior of the drum to the volatile organic compound oxidation means; whereby the pollutants conducted to the volatile organic compound oxidation means are oxidized in response to heat supplied by the heating means. In addition, the apparatus includes selectively detachable coupling means coupling the heating means with the interior of the heating chamber. Further, the rotational means may include electric motor means coupled with the drum for rotating the drum; and the heating means may comprise a heat-cycle operated engine having a heated exhaust for supplying heat to the interior of the heating chamber, and an electric power generator operated by the engine for supplying power to the electric motor means.

The invention will be understood more fully, while still further objects and advantages will become apparent in the following detailed description of preferred embodiments of the invention illustrated in the accompanying drawing, in which.

Figure 1:
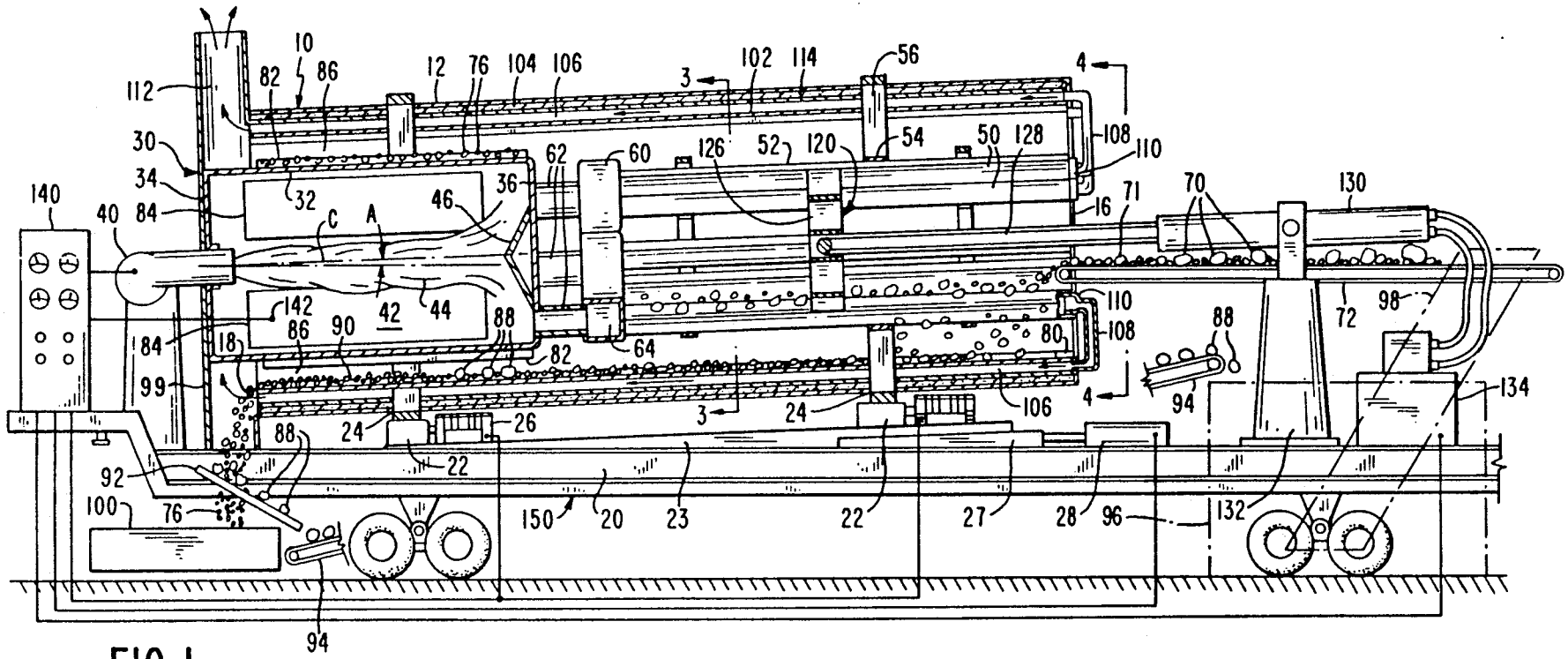
FIG. 1 is a somewhat diagrammatic, longitudinal cross-sectional view of an apparatus constructed in accordance with the present invention, illustrating one embodiment of the invention.
Figure 2:
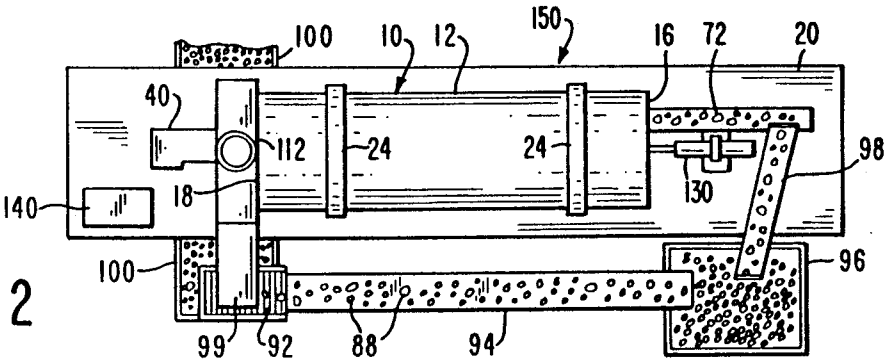
FIG. 2 is a plan view, reduced in size, of the apparatus of FIG. 1.

Referring now to the drawing, and especially to FIGS. 1 and 2 thereof, an apparatus constructed in accordance with the present invention is illustrated generally at 10 and is seen to include an elongate drum 12 having a generally cylindrical wall 14 extending axially between an inlet end 16 and an outlet end 18. Drum 12 is mounted upon a platform 20 for rotation about a central axis C by means of roller assemblies 22 placed on a base 23 on the platform 20 and engaging corresponding circumferential tracks 24 carried by the drum 12, and motors 26 drive the roller assemblies 22, all in a manner now well known in asphalt processing apparatus. Alternately, a separate chain-and-sprocket drive may couple the motors 26 with the drum 12. The base 23 is inclined so that the inlet end 16 of the drum 12 is elevated relative to the outlet end 18. The angle of inclination A is maintained relatively shallow, an angle A of only about four degrees being sufficient for the purposes to be described below. Angle A is selectively adjusted by adjustment means shown in the form of a wedge 27 moved forward or backward by an actuator 28 to increase or decrease the magnitude of angle A.

Figure 3:
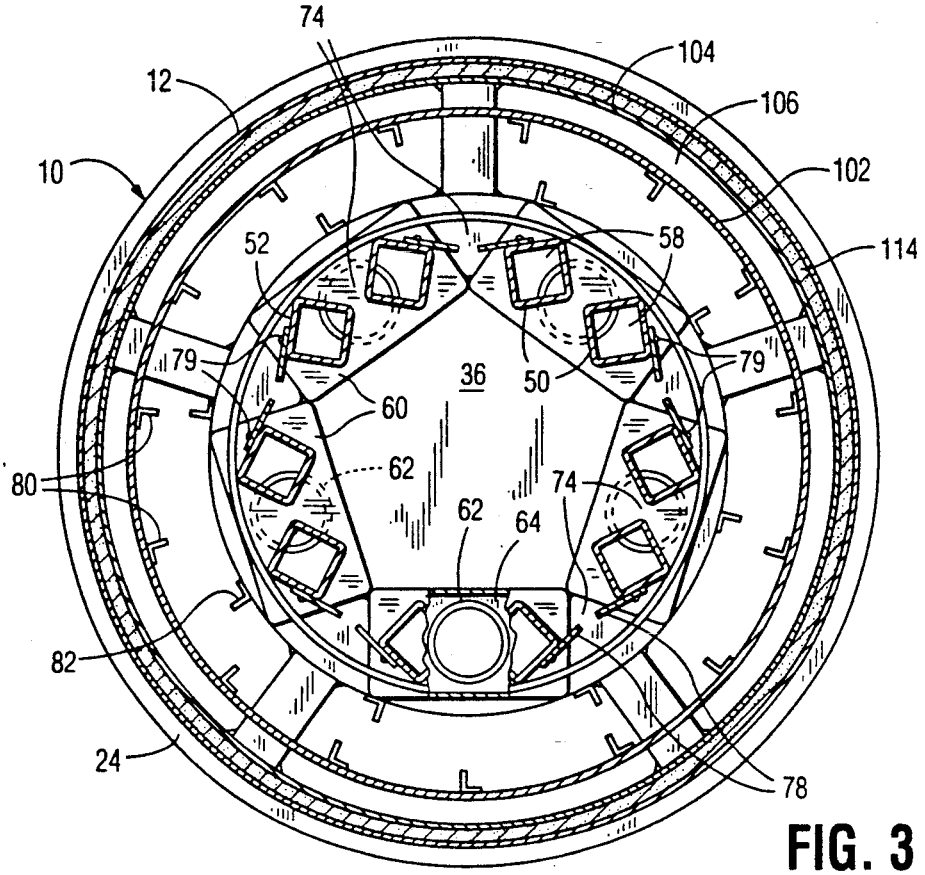
FIG. 3 is an enlarged cross-sectional view taken along line 3—3 of FIG. 1.
Figure 4:
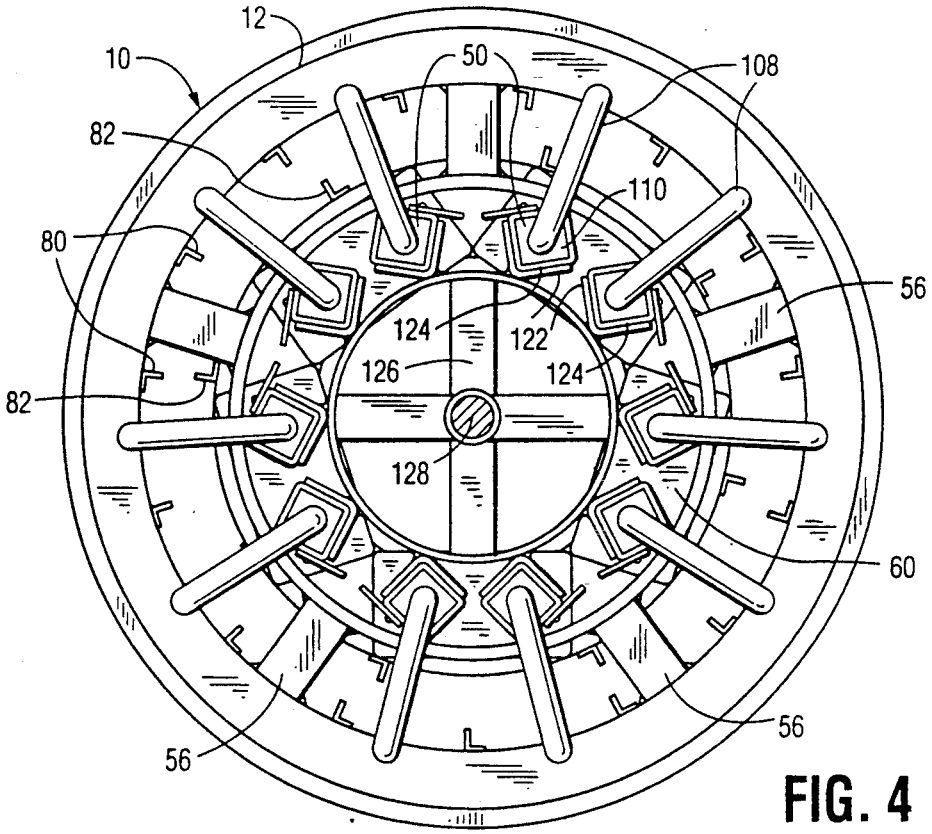
FIG. 4 is an enlarged cross-sectional view taken along line 4—4 of FIG. 1.

A heating chamber 30 is located adjacent the outlet end 18 of the drum 12 and includes a cylindrical side wall 32 which extends along the drum 12 toward the inlet end 16 over a first axial portion of drum 12 from a rear wall 34 to a front wall 36. Heating means in the form of a burner 40 is mounted on the platform 20 outside the heating chamber 30 and projects into the interior 42 of the heating chamber 30 through the rear wall 34 to provide a heating flame 44 within the interior 42 of the heating chamber 30. Heating flame 44 impinges upon a baffle 46 at the front wall 36. A plurality of breaker members in the form of tubular members 50 extend axially, along a second axial portion of drum 12, between the heating chamber 30 and the inlet end 16 of the drum 12, generally parallel to the central axis C, and are arrayed circumferentially about the central axis C. The tubular members 50 are assembled into a cage-like assembly 52 which is supported within the drum 12 by a support ring 54 and struts 56. As illustrated in FIGS. 3 and 4, each tubular member 50 has an interior 58 which extends axially along the length of the tubular member 50. Headers in the form of manifolds 60 are integral with the ends of the tubular members 50 adjacent the heating chamber 30, and the manifolds 60 are integral with the front wall 36 of the heating chamber 30 to connect the tubular members 50 with the heating chamber 30. As best seen in FIG. 3, as well as in FIG. 1, two tubular members 50 are connected to each manifold 60 and each manifold 60 has a single leg 62 connected to the front wall 36 of the heating chamber 30. The interior 58 of each tubular member 50 communicates with the interior 42 of the heating chamber 30 through the interior 64 of each corresponding manifold 60 so that hot gases generated in the heating chamber 30 pass through the manifolds 60 and into the tubular members 50.

Recyclable asphalt material is received from the field in relatively large pieces 70 usually in chunks spanning about one foot across and is fed directly into apparatus 10, as seen at 71. The large pieces 70 are fed by an infeed conveyor 72 through the inlet end 16 of the drum 12 and into the cage-like assembly 52 established by the array of tubular members 50. As the drum 12 is rotated, the cage-like assembly 52 also rotates about the central axis C and the large pieces 70 are tumbled within the cage-like assembly 52 and simultaneously are broken up and heated by contact with the tubular members 50 of the cage-like assembly 52 as the recyclable asphalt material proceeds downstream from the inlet end 16 toward the outlet end 18 of the drum 12. The circumferential spacing 74 between adjacent tubular members 50 is selected so that upon reaching the desired aggregate-size, the recyclable asphalt material 76 will drop out of the cage-like assembly 52, and fall to wall 14 of the drum 12. A preferred circumferential spacing 74 is a gap of about two to four inches between adjacent tubular members 50, which circumferential spacing yields a desired size of about three-quarters of an inch in the recycled asphalt material which leaves the drum 12 at the outlet end 18. Auxiliary bars 78 are affixed to some of the tubular members 50 and extend circumferentially to assure that the prescribed spacing 74 is maintained between all adjacent tubular members 50. The spacing 74 between adjacent auxiliary bars 78 is adjustable by means of selectively loosened fasteners 79 which secure the auxiliary bars 78 to the tubular members 50. The desired aggregate-sized recyclable asphalt material 76 continues down the wall 14 of the drum 12, assisted by flights 80 affixed to the wall 14, until the material 76 reaches the outlet end 18 of the drum 12. In addition, material 76 is tumbled onto the side wall 32 of the heating chamber 30 where additional heat is transferred to the material 76 and further flights 82 affixed to side wall 32 assist in moving the material 76 downstream. The side wall 32 of the heating chamber 30 is provided with access panels 84 which enable selective access to the interior portion 86 of the drum 12 around the heating chamber 30 from the interior 42 of the heating chamber 30, so that in the event of a sudden shut-down due to a power failure or the like and a consequent cessation of rotation of the drum 12, the mass of material 76 in the interior portion 86 can be removed while still essentially molten.

The legs 62 of the manifolds 60 are spaced apart circumferentially a distance greater than the spacing 74 between the tubular members 50. Thus, intermediate-sized pieces 88 of recyclable asphalt material which now are smaller than pieces 70, but still remain larger than that which is permitted to fall through spacing 74, will fall between the legs 62 to enter the mass of material in the stream 90 of asphalt material leaving the drum 12. After leaving the drum 12, the stream 90 is passed through a screen 92 where the intermediate-sized pieces 88 are separated and transferred to a back feed conveyor 94. Back feed conveyor 94 delivers the intermediate-sized pieces 88 to a bin 96, and an elevator 98 moves the intermediate-sized pieces 88 from the bin 96 to the infeed conveyor 72 for return to the drum 12. The stream 90 of desired aggregate-sized pieces of material 76 is delivered through an exit chute 99 to an outfeed conveyor 100 for use. It is noted that at no time is the recyclable asphalt material exposed to direct flame. Moreover, introduction of the recyclable asphalt material at the inlet end 161, remote from the heating chamber 30, presents the recyclable asphalt material at the lower temperature end of the drum 12, and the temperature is raised gradually as the material progresses toward the outlet end 18, thereby reducing any tendency toward generating excessive harmful pollutants.

In the preferred configuration, wall 14 of drum 12 is comprised of an inner wall 102 and an outer wall 104, with an annular heat chamber 106 between the inner wall 102 and the outer wall 104. Return members in the form of elbows 108 are connected between the end 110 of each tubular member 50 and the annular heat chamber 106 so that the heated gases which pass from the heating chamber 30 through the tubular members 50 is directed into the annular heat chamber 106 to flow through the wall 14 of the drum 12 and further heat the wall 14 as the heated gases are passed to an exhaust port 112 at the downstream, outlet end 18 of the drum 12. In this manner heat is conserved and more heat is made available for the process. An insulating jacket 114 extends circumferentially around the drum 12 to further conserve heat, as explained in U.S. Pat. No. 4,932,863.

In order to preclude the deleterious build up of excessive asphalt on the tubular members 50, a scraper assembly 120 is mounted for reciprocating movement along the cage-like assembly 52. Referring to FIG. 4. as well as to FIG. 1. scrapers 122 are engaged with the outer surfaces 124 of the tubular members 50 and are affixed to a spider 126 which is carried by a spindle 128. Spindle 128 is reciprocated in upstream and downstream directions periodically by selective actuation of a hydraulic cylinder 130 mounted on a pedestal 132 on platform 20 and actuated under the control of control box 134. Upon actuation of the hydraulic cylinder 130, scrapers 132 will ride upon and move along the outer surfaces 124 of the tubular members 50 to scrape away excessive asphalt and maintain the surfaces 124 free to transfer heat to the pieces 70 of recyclable asphalt being tumbled in the cage-like assembly 52. Tubular members 50 preferably are provided with a rectangular cross-sectional configuration, as shown in FIGS. 3 and 4.

A central control console 140 controls various parameters in the operation of the apparatus 10. Thus, the control console 140 is operated to control the speed of rotation of the motors 26 to select the speed of rotation of drum 12. A temperature sensor 142 in the heating chamber 30 is connected to the control console 140 which, in turn, controls the burner 40 to maintain the temperature within the interior 42 of the heating chamber 30 at a selected level. Further, the selected pitch of the drum 12 is controlled by the control console 140 through operation of the actuator 28. In addition, the control console 140 controls the operation of the scraper assembly 120. Typically, angle A is set at about three to six degrees, the temperature in the interior of the heating chamber 30 is within the range of about fifteen-hundred to two-thousand degrees F., and the speed of rotation of the drum 12 is within the range of about five to seven revolutions per minute. The temperature of the recycled asphalt material exiting at the outlet end 18 of the drum 12 is about two-hundred to two-hundred-fifty degrees F.

Platform 20 is a part of a truck trailer 150 so that the apparatus 10 is portable and is made available readily at a work site. The apparatus 10 is compact and requires very little by way of facilities in order to operate in the field.

Figure 5:
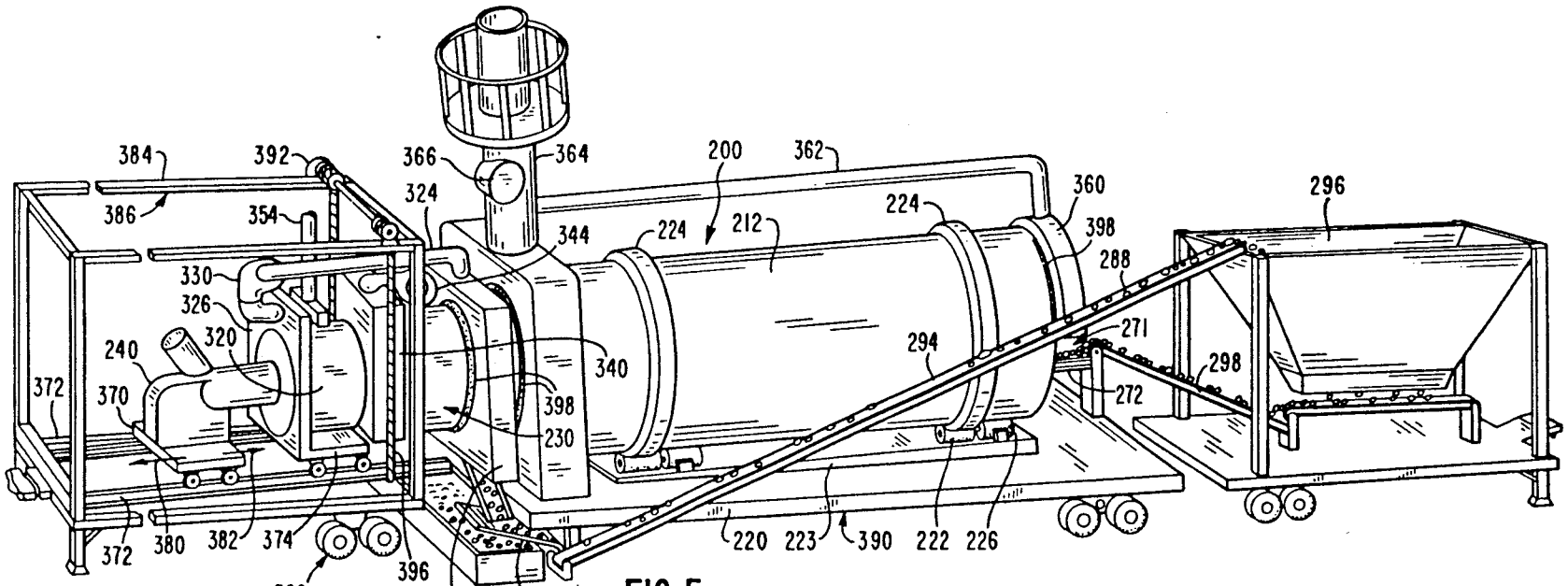
FIG. 5 is pictorial view showing another embodiment of the invention.
Figure 6:
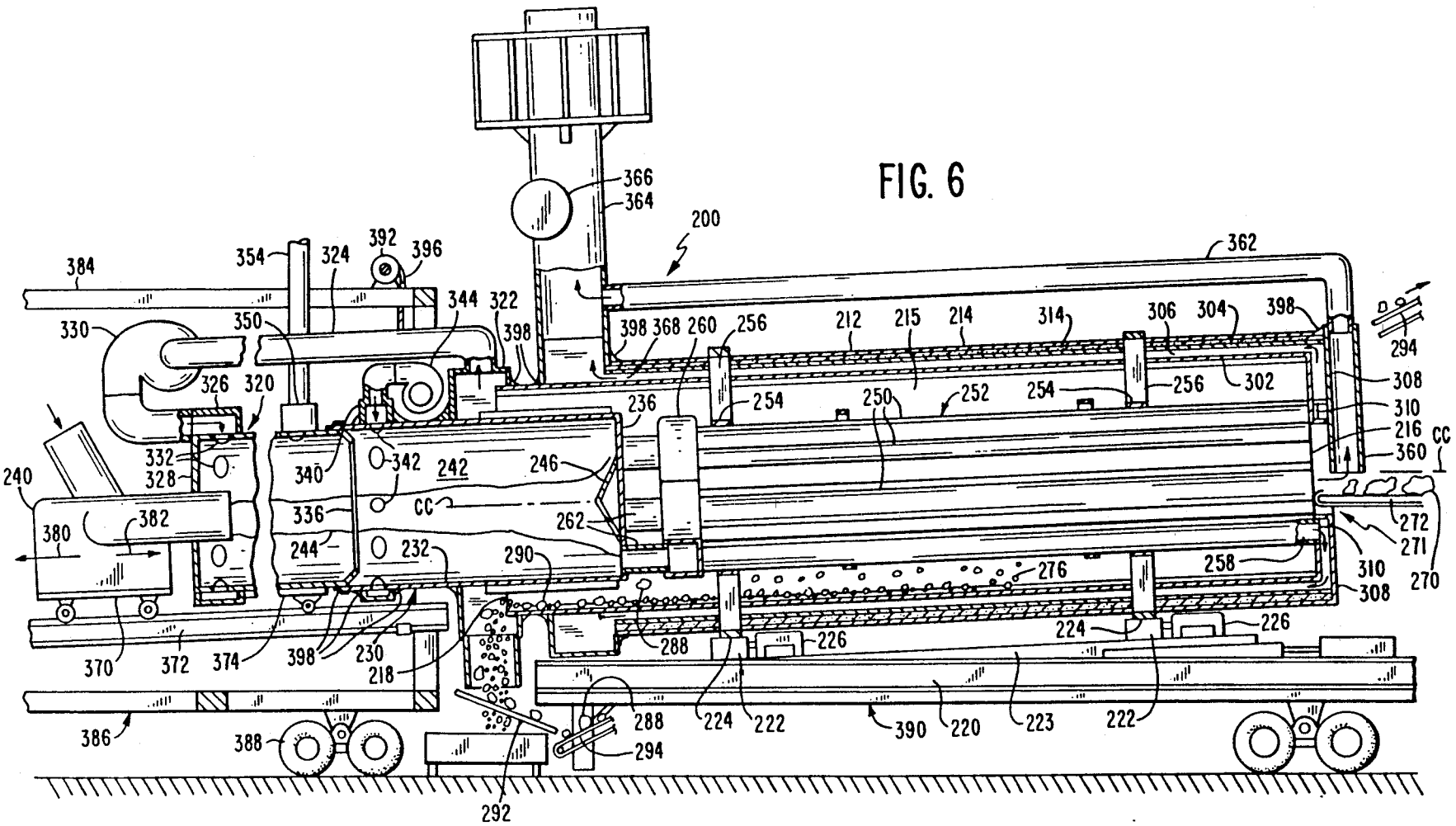
FIG. 6 is a somewhat diagrammatic, longitudinal cross-sectional view of the apparatus of FIG. 5.

Turning now to FIGS. 5 and 6, another embodiment of the invention is illustrated in the form of apparatus 200 which is seen to include an elongate drum 212 having a generally cylindrical wall 214 and an interior 215 extending axially between an inlet end 216 and an outlet end 218. Drum 212 is mounted upon a platform 220 for rotation about a central axis CC by means of roller assemblies 222 placed on a base 223 on the platform 220 and engaging corresponding circumferential tracks 224 carried by the drum 212, and electric motors 226 drive the roller assemblies 222, all in a manner similar to that described above in connection with apparatus 10. Alternately, a separate chain-and-sprocket drive may couple the electric motors 226 with the drum 212. The base 223 is inclined so that the inlet end 216 of the drum 212 is elevated relative to the outlet end 218. The angle of inclination is maintained relatively shallow and is adjustable, all as described above in connection with apparatus 10.

A heating chamber 230 is located adjacent the outlet end 218 of the interior 215 of the drum 212 and includes a cylindrical side wall 232 which extends along the drum 212 toward the inlet end 216 over a first axial portion of drum 212 from an inlet end 234 of the heating chamber 230 to a front wall 236. A burner 240 is located outside the heating chamber 230 and projects toward the interior 242 of the heating chamber 230 to provide a heating flame 244 projecting toward the interior 242 of the heating chamber 230. A baffle 246 is provided at the front wall 236. A plurality of breaker members in the form of tubular members 250 extend axially, along a second axial portion of drum 212, between the heating chamber 230 and the inlet end 216 of the interior 215 of the drum 212, generally parallel to the central axis CC, and are arrayed circumferentially about the central axis CC. The tubular members 250 are assembled into a cage-like assembly 252 which is supported within the drum 212 by support rings 254 and struts 256. As described in connection with tubular members 50 above, each tubular member 250 has an interior 258 which extends axially along the length of the tubular member 250. Headers in the form of manifolds 260 are integral with the ends of the tubular members 250 adjacent the heating chamber 230, and the manifolds 260 are integral with the front wall 236 of the heating chamber 230 to connect the tubular members 250 with the heating chamber 230. As before, two tubular members 250 are connected to each manifold 260 and each manifold 260 has a single leg 262 connected to the front wall 236 of the heating chamber 230. The interior 258 of each tubular member 250 communicates with the interior 242 of the heating chamber 230 through the interior 264 of each corresponding manifold 260 so that hot gases in the heating chamber 230 pass through the manifolds 260 and into the tubular members 250.

Recyclable asphalt material is received from the field in relatively large pieces 270, usually in chunks spanning about one foot across and is fed directly into apparatus 200, as seen at 271. The large pieces 270 are fed by an infeed conveyor 272 through the inlet end 216 of the interior 215 of drum 212 and into the cage-like assembly 252 established by the array of tubular members 250. As the drum 212 is rotated, the cage-like assembly 252 also rotates about the central axis CC and the large pieces 270 are tumbled within the cage-like assembly 252 and simultaneously are broken up and heated by contact with the tubular members 250 of the cage-like assembly 252 as the recyclable asphalt material proceeds downstream from the inlet end 216 toward the outlet end 218 of the interior 215 of drum 212. The circumferential spacing between adjacent tubular members 250 is selected so that upon reaching the desired aggregate-size, the recyclable asphalt material 276 will drop out of the cage-like assembly 252, and fall to wall 214 of the drum 212, all as described above in connection with apparatus 10. The desired aggregate-sized recyclable asphalt material 276 continues down the wall 214 of the drum 212, assisted by flights 280 affixed to the wall 214, until the material 276 reaches the outlet end 218 of the interior 215 of the drum 212. In addition, material 276 is tumbled onto the side wall 232 of the heating chamber 230 where additional heat is transferred to the material 276 and further flights 282 affixed to side wall 232 assist in moving the material 276 downstream.

The legs 262 of the manifolds 260 are spaced apart circumferentially a distance greater than the spacing between the tubular members 250. Thus, intermediate-sized pieces 288 of recyclable asphalt material which now are smaller than pieces 270, but still remain larger than that which is permitted to fall through the spacing between the tubular members 250, will fall between the legs 262 to enter the mass of material in the stream 290 of asphalt material leaving the drum 212. After leaving the drum 212, the stream 290 is passed through a screen 292 where the intermediate-sized pieces 288 are separated and transferred to a back feed conveyor 294. Back feed conveyor 294 delivers the intermediate-sized pieces 288 to a bin 296, and an elevator 298 moves the intermediate-sized pieces 288 from the bin 296 to the infeed conveyor 272 for return to the drum 212. The stream 290 of desired aggregate-sized pieces of material 276 is delivered through an exit chute to an outfeed conveyor, as described before.

In the preferred configuration, wall 214 of drum 212 is comprised of an inner wall 302 and an outer wall 304, with an annular heat chamber 306 between the inner wall 302 and the outer wall 304. Return members in the form of elbows 308 are connected between the end 310 of each tubular member 250 and the annular heat chamber 306 so that the heated gases which pass from the heating chamber 230 through the tubular members 250 are directed into the annular heat chamber 306 to flow through the wall 214 of the drum 212 and further heat the wall 214 as the heated gases are passed downstream. In this manner heat is conserved and more heat is made available for the process. An insulating jacket 314 extends circumferentially around the drum 212 to further conserve heat, as explained in U.S. Pat. No. 4,932,863.

It is noted that at no time is the recyclable asphalt material exposed to direct flame. Moreover, introduction of the recyclable asphalt material at the inlet end 216, remote from the heating chamber 230, presents the recyclable asphalt material at the lower temperature end of the drum 212, and the temperature is raised gradually as the material progresses toward the outlet end 218, thereby reducing any tendency toward generating excessive harmful pollutants. However, any harmful pollutants which may be generated in the interior 215 of the drum 212 during the process is dealt with in apparatus 200, as described below.

Volatile pollutants which emanate from the recyclable asphalt material as the process is being carried out in the apparatus 200 are dealt with by oxidizing the pollutants in a volatile organic compound oxidation device 320. To that end, the volatile pollutants are conducted from the interior 215 of the drum 212 to the volatile organic compound oxidation device 320 by gas conduction means shown in the form of a manifold 322 located adjacent the outlet end 218 of the interior 215 of the drum 212 and a duct 324 extending between and communicating with the manifold 322 and a plenum chamber 326 extending around the outer periphery of the volatile organic compound oxidation device 320 at the inlet end 328 of the volatile organic compound oxidation device 320. A fan 330 draws the volatile pollutants from the interior 215 of the drum 212, through the manifold 322 and duct 324, and forces the volatile pollutants into the plenum chamber 326, to pass through openings 332 into the volatile organic compound oxidation device 320.

The volatile organic compound oxidation device 320 is a device of a type well known in the art of pollution control and operates in response to heat to oxidize the volatile pollutants delivered from the interior 215 of the drum 212. By interposing the device 320 between the burner 240 and the heating chamber 230, the burner 240 provides the heat necessary to operate the device 320, thus rendering the use of the device 320 economical and practical. Upon oxidation of the pollutants in the device 320, additional heat is produced by the oxidation reaction. Should the heat become too intense for safe introduction into the heating chamber 230, cooling means interposed between the volatile organic compound oxidation device 320 and the heating chamber 230 is employed to reduce the temperature between the outlet 336 of the volatile organic compound oxidation device 320 and the interior 242 of the heating chamber 230. Thus, air distribution means in the form of a plenum 340 is placed on the volatile organic compound oxidation device 320 so as to be located adjacent the inlet end 234 of the heating chamber 230 and communicate with the interior 242 of the heating chamber 230 through apertures 342. A blower 344 forces ambient air into the plenum 340 to be distributed into the volatile organic compound oxidation device 320 and to the interior 242 of the heating chamber 230 for reducing the temperature at the inlet end 234 of the heating chamber 230. Alternately, the plenum 340 may be placed on the heating chamber 230 itself, adjacent the inlet end 234 of the heating chamber 230 and the outlet 336 of the volatile organic compound oxidation device 320, rather than on the volatile organic compound oxidation device 320, for reducing the temperature at the inlet end 234 of the heating chamber 230. In either arrangement, the cooling means is interposed between the volatile organic compound oxidation device 320 and the heating chamber 230 for distributing ambient air to the interior of the heating chamber 230 to reduce the temperature at the inlet end 234 of the heating chamber 230.

When use of the apparatus 200 is to be discontinued, there is a gradual slow-down in production in the drum 212, requiring lowered heat to the tubular members 250; however, full heat must be maintained in the volatile organic compound oxidation device 320 for continued appropriate operation during the transition from full operation to full shut-down. Accordingly, heat is bypassed by the opening of a damper 350 located adjacent the outlet 336 of the volatile organic compound oxidation device 320, which damper 350 is opened to vent excess heat through a stack 354 in order to bypass heat from the volatile organic compound oxidation device 320 away from the heating chamber 230 and thereby protect the component parts of the apparatus 200 against excessively high temperatures during cool down. As a further measure of protection against the effects of excessive heat, it is preferable to construct the heating chamber 230, the manifolds 260 and at least the portions of the tubular members 250 located adjacent the manifolds 260 and the heating chamber 230, of a heat and corrosion resistant alloy, such as stainless steel.

Residual emissions and steam emanating from the inlet end 216 of the interior 215 of the drum 212 are collected by means shown in the form of an auxiliary hood 360 placed adjacent the inlet end 216. A duct 362 communicates with the hood 360 and provides a passage to an auxiliary stack 364 within which an exhaust fan 366 operates to exhaust the emissions and steam collected in the hood 360. The heated gases exhausted from the tubular members 250 also are passed into the auxiliary stack 364, as seen at 368, to be exhausted to the atmosphere. Alternately, should the residual emissions contain excessive pollutants, duct 362 may be routed to plenum 340, instead of to auxiliary stack 364.

In order to enhance the portability and versatility of the apparatus 200, as well as enable ready access to the interior 242 of the heating chamber 230 for cleaning and maintenance, the burner 240 and the volatile organic compound oxidation device 320 are selectively detached from the heating chamber 230 by coupling mean which enable the selective translation of the burner 240 and the volatile organic compound oxidizing device 320 into and out of coupled engagement with the heating chamber 230. Thus, the burner 240 is mounted upon a wheeled carriage 370 which, in turn, is placed upon tracks 372 extending longitudinally essentially parallel to the central axis CC of the drum 212. Likewise, the volatile organic compound oxidizing device 320 is mounted on a wheeled carriage 374 which, in turn, is placed upon the tracks 372. The burner 240 and the device 320 are selectively translated along the tracks 372 in the direction 380 away from the drum 212 in order to retract and uncouple the burner 240 and the device 320 from the heating chamber 230 to expose the interior 242 of the heating chamber 230. The burner 240 and the device 320 are advanced, by translation along the tracks 372 in the direction 382, so as to telescopically engage the volatile organic compound oxidation device 320 and the heating chamber 230 to couple the burner 240 and the device 320 with the heating chamber 230 for operation of the apparatus 200. The tracks 372 are supported on a frame 384 of a smaller trailer 386 having a carriage 388 for transport independent of the truck trailer 390 upon which the drum 212 is carried. A winch 392 is mounted upon the frame 384 of the trailer 386 and is coupled with the tracks 372 by means of cables 396 in order to enable selective upward and downward movement of the forward ends of the tracks 372 so as to align the tracks 372 generally parallel with the central axis CC of the drum 212 and place the burner 240 and the device 320 in appropriate alignment for coupling with the heating chamber 230. Dynamic seals 398 are provided between those component parts which rotate with the rotation of the drum 212 and those component parts which remain stationary.

Figure 7:
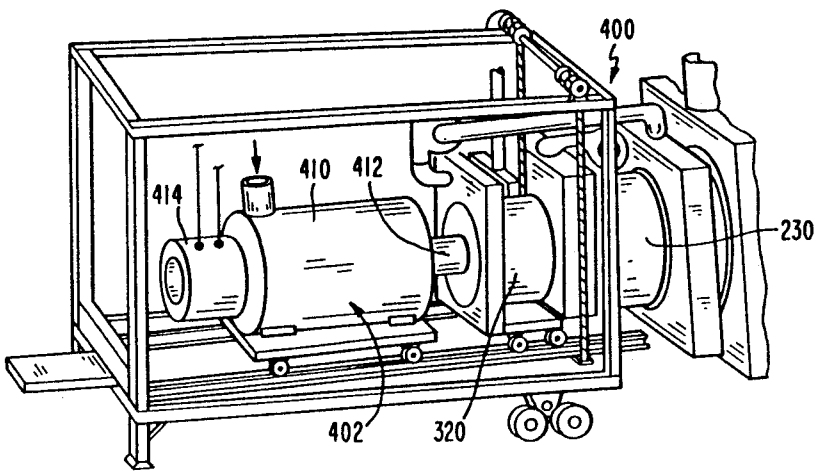
FIG. 7 is a fragmentary pictorial view showing still another embodiment of the invention.

In the embodiment of FIG. 7, another apparatus 400 is shown, which is similar in construction and operation to apparatus 200, except that the burner 240 has been replaced by another heating means 402 for providing a source of heat for the volatile organic compound oxidation device 320 and the heating chamber 230. In this instance, the heating means is a heat-cycle operated engine shown in the form of a gas turbine 410, and the exhaust of the gas turbine 410 is coupled at 412 to the volatile organic compound oxidation device 320 to provide the heat necessary to operate apparatus 400. The gas turbine 410 is coupled to a generator 414 for generating electrical power, some of which is used to operate the electric motors 226 which rotate the drum 212. Electric power from generator 414 also is made available for other power requirements at the site of the apparatus. Thus, apparatus 400 not only is self-contained for use at a variety of sites, but provides electrical power at the site.

It will be seen that the present invention attains the objects and advantages summarized above, namely: Eliminates the need for preliminary crushing and screening of recyclable asphalt materials received from the field, and the equipment needed for such preliminary crushing and screening precludes direct contact between the recyclable asphalt materials and any open flame or hot gases thereby eliminating a potential source of pollutants, and especially "blue-smoke" and hydrocarbon emissions; effectively recycles used asphalt materials for use either in a mix containing a very high percentage of recycled product with virgin aggregate and asphalt or one-hundred percent recycled materials; provides apparatus which is relatively compact and even more portable than before for ready transportation and use directly at a wider variety of project sites; enables increased versatility in complementing existing asphalt plants for the use of recycled asphalt product; provides an environmentally sound approach to the conservation of asphalt products at minimal cost; eliminates the need for disposal of used asphalt materials;

effectively deals with pollutants which emanate from the asphalt materials being processed for reuse enables the practical processing of recyclable asphalt materials for widespread use with efficiency and reliability.

It is to be understood that the above detailed description of preferred embodiments of the invention are provided by way of example only. Various details of design, construction and procedure may be modified without departing from the true spirit and scope of the invention as set forth in the appended claims.

The embodiments of the invention in which an exclusive property or privilege is claimed are defined as follows:

1. Apparatus for processing recyclable asphalt material received from the field in relatively large pieces for delivery in a mass containing desired smaller aggregate-sized pieces for reuse, the apparatus comprising:

an elongate drum having a generally cylindrical wall, a central axis, and an interior with an inlet end and an outlet end;

mounting means for mounting the drum for rotation about the central axis;

a heating chamber adjacent one end of the interior of the drum and extending along the drum toward the other end of the interior of the drum over a first axial portion of the drum, the heating chamber having an interior;

a plurality of breaker members connected to the heating chamber for the conduction of heat from the heating chamber to the breaker members, the breaker members being tubular and extending from the heating chamber along a second axial portion of the drum toward the other end of the drum, each breaker member having an interior extending along the axial length of the breaker member and each interior being in communication with the interior of the heating chamber;

heating means for supplying heat to the interior of the heating chamber, such that heat is conducted to the breaker members connected to the heating chamber;

feed means for feeding the large pieces of recyclable asphalt material received from the field into the drum, adjacent the inlet end of the interior of the drum;

rotational means for rotating the drum about the central axis so as to tumble the large pieces of recyclable asphalt along the drum and the breaker members, thereby simultaneously reducing the size of the relatively large pieces to the desired aggregate-sized pieces and heating the mass containing the desired aggregate-sized pieces, which mass proceeds toward the outlet end for delivery at the outlet end of the interior of the drum; and selectively detachable coupling means coupling the heating means with the interior of the heating chamber.

2. The invention of claim 1 wherein the selectively detachable coupling means includes translation means for enabling selective translation of the heating means essentially parallel to the central axis of the drum, toward and away from the drum for corresponding selective coupling and uncoupling of the heating means and the interior of the heating chamber.

3. The invention of claim 2 wherein the heating means and the selectively detachable coupling means are located adjacent the outlet end of the interior of the drum.

4. Apparatus for processing recyclable asphalt material received from the field in relatively large pieces for delivery in a mass containing desired smaller aggregate-sized pieces for reuse, the apparatus comprising:

an elongate drum having a generally cylindrical wall, a central axis, and an interior with an inlet end and an outlet end;

mounting means for mounting the drum for rotation about the central axis;

a heating chamber adjacent one end of the interior of the drum and extending along the drum toward the other end of the interior of the drum over a first axial portion of the drum, the heating chamber having an interior;

a plurality of breaker members connected to the heating chamber for the conduction of heat from the heating chamber to the breaker members, the breaker members being tubular and extending from the heating chamber along a second axial portion of the drum toward the other end of the interior of the drum, each breaker member having an interior extending along the axial length of the breaker member and each interior being in communication with the interior of the heating chamber;

heating means for supplying heat to the interior of the heating chamber, such that heat is conducted to the breaker members connected to the heating chamber;

feed means for feeding the large pieces of recyclable asphalt material received from the field into the drum, adjacent the inlet end of the interior of the drum;

rotational means for rotating the drum about the central axis so as to tumble the large pieces of recyclable asphalt along the drum and the breaker members, thereby simultaneously reducing the size of the relatively large pieces to the desired aggregate-sized pieces and heating the mass containing the desired aggregate-sized pieces, which mass proceeds toward the outlet end for delivery at the outlet end of the interior of the drum;

volatile organic compound oxidation means interposed between the heating means and the heating chamber, the volatile organic compound oxidation means having an inlet and an outlet, the inlet communicating with the heating means and the outlet communicating with the heating chamber; and gas conduction means interconnecting the interior of the drum with the inlet of the volatile organic compound oxidation means for conducting pollutants from the interior of the drum to the volatile organic compound oxidation means;

whereby the pollutants conducted to the volatile organic compound oxidation means are oxidized in response to heat supplied by the heating means.

5. The invention of claim 4 wherein the gas conduction means interconnects the interior of the drum adjacent the outlet end of the interior of the drum with the inlet of the volatile organic compound oxidation means.

6. The invention of claim 4 including cooling means interposed between the outlet of the volatile organic compound oxidation means and the heating chamber for reducing the temperature between the outlet of the volatile organic compound oxidation means and the interior of the heating chamber.

7. The invention of claim 6 wherein the cooling means includes air distribution means for distributing ambient air between the outlet of the volatile organic compound oxidation means and the interior of the heating chamber.

8. The invention of claim 7 wherein the volatile organic compound oxidation means includes an outer perimeter at the inlet of the volatile organic compound oxidation means, and gas distribution means at the inlet of the volatile organic compound oxidation means for distributing the pollutants conducted by the gas conduction means along the outer perimeter at the inlet of the volatile organic compound oxidation means.

9. The invention of claim 8 wherein the gas conduction means interconnects the interior of the drum adjacent the outlet end of the drum with the inlet of the volatile organic compound oxidation means.

10. The invention of claim 4 including residual emission collection means adjacent the inlet end of the interior of the drum.

11. The invention of claim 4 wherein the rotational means include electric motor means coupled with the drum for rotating the drum, and the heating means comprises a heat-cycle operated engine having a heated exhaust for supplying heat to the interior of the heating chamber, and an electric power generator operated by the engine for supplying power to the electric motor means.

12. The invention of claim 11 wherein the engine comprises a gas turbine.

13. Apparatus for location at a site to process recyclable asphalt material received from the field in relatively large pieces for delivery in a mass containing desired smaller aggregate-sized pieces for reuse, the apparatus comprising:

an elongate drum having a generally cylindrical wall, a central axis, and an interior with an inlet end and an outlet end;

mounting means for mounting the drum for rotation about the central axis;

a heating chamber adjacent one end of the interior of the drum and extending along the drum toward the other end of the interior of the drum over a first axial portion of the drum, the heating chamber having an interior;

a plurality of breaker members connected to the heating chamber for the conduction of heat from the heating chamber to the breaker members, the breaker members being tubular and extending from the heating chamber along a second axial portion of the drum toward the other end of the interior of the drum, each breaker member having an interior extending along the axial length of the breaker member and each interior being in communication with the interior of the heating chamber;

heating means for supplying heat to the interior of the heating chamber, such that heat is conducted to the breaker members connected to the heating chamber;

feed means for feeding the large pieces of recyclable asphalt material received from the field into the drum, adjacent the inlet end of the interior of the drum; and rotational means for rotating the drum about the central axis so as to tumble the large pieces of recyclable asphalt along the drum and the breaker members, thereby simultaneously reducing the size of the relatively large pieces to the desired aggregate-sized pieces and heating the mass containing the desired aggregate-sized pieces, which mass proceeds toward the outlet end for delivery at the outlet end of the interior of the drum;

the heating means comprising a heat-cycle operated engine having a heated exhaust for supplying heat to the interior of the heating chamber and an electric power generator operated by the engine for supplying electric power to the site.

14. The invention of claim 13 wherein the engine comprises a gas turbine.

15. The invention of claim 13 wherein the rotational means includes electric motor means coupled with the drum for rotating the drum, and the electric power generator supplies electric power to the electric motor means.

16. The invention of claim 15 wherein the engine comprises a gas turbine.

* * * * *